US009273429B2

(12) United States Patent
Douglas et al.

(10) Patent No.: US 9,273,429 B2
(45) Date of Patent: Mar. 1, 2016

(54) METHOD AND APPARATUS FOR MANUFACTURING LIGNOCELLULOSIC MATERIALS WITH IMPROVED PROPERTIES

(71) Applicants: W. J. Murray Douglas, Baie d'Urfé (CA); S. J. Hashemi, Pierrefonds (CA)

(72) Inventors: W. J. Murray Douglas, Baie d'Urfé (CA); S. J. Hashemi, Pierrefonds (CA)

( * ) Notice: Subject to any disclaimer, the term of this patent is extended or adjusted under 35 U.S.C. 154(b) by 0 days.

(21) Appl. No.: 14/367,350

(22) PCT Filed: Dec. 20, 2012

(86) PCT No.: PCT/CA2012/050926

§ 371 (c)(1),
(2) Date: Jun. 20, 2014

(87) PCT Pub. No.: WO2013/091105

PCT Pub. Date: Jun. 27, 2013

(65) Prior Publication Data

US 2014/0345818 A1 Nov. 27, 2014

Related U.S. Application Data

(60) Provisional application No. 61/577,938, filed on Dec. 20, 2011.

(51) Int. Cl.

| | |
|---|---|
| ***D21F 7/00*** | (2006.01) |
| ***D21H 25/04*** | (2006.01) |
| ***D21J 1/00*** | (2006.01) |
| ***D21F 5/00*** | (2006.01) |

(52) U.S. Cl.
CPC ..... *D21F 7/008* (2013.01); *D21F 5/002* (2013.01); *D21H 25/04* (2013.01); *D21J 1/00* (2013.01)

(58) Field of Classification Search
USPC ..... 162/192, 207
IPC ..... D21F 7/00; D21H 25/04; D21J 1/00
See application file for complete search history.

(56) References Cited

U.S. PATENT DOCUMENTS

| | | | | |
|---|---|---|---|---|
| 4,612,231 | A | 9/1986 | Bouchette et al. | |
| 5,666,744 | A | 9/1997 | Thorp | |
| 5,992,040 | A * | 11/1999 | Nordang | 34/114 |
| 6,742,280 | B1 * | 6/2004 | Andren et al. | 34/358 |
| 7,758,722 | B2 * | 7/2010 | Saueressig | 162/50 |
| 2010/0096095 | A1 * | 4/2010 | Bergman | 162/148 |

OTHER PUBLICATIONS

ISR of Corresponding PCT/CA2012/050926, Mar. 2013.

* cited by examiner

*Primary Examiner* — Mark Halpern
(74) *Attorney, Agent, or Firm* — Norton Rose Fulbright Canada LLP

(57) ABSTRACT

A method and apparatus for treating a wet or moist lignocellulosic material at a moisture content which is in a range from above the $X_{fsp}$ value of the material down to about 0.1 kg water/kg dry below the $X_{fsp}$ value, where $X_{fsp}$ is the fiber saturation point value, with rapid warming of the wet or moist lignocellulosic material to a level that natural polymers in the lignocellulosic material soften, which changes the microstructure and results in improved properties of the lignocellulosic material.

12 Claims, 10 Drawing Sheets

METHOD AND APPARATUS FOR MANUFACTURING LIGNOCELLULOSIC MATERIALS WITH IMPROVED PROPERTIES

CROSS-REFERENCE TO RELATED APPLICATIONS

The present application claims benefit of U.S. Provisional Application No. 61/577,938, filed Dec. 20, 2011, and is a National Phase Entry of PCT application No. PCT/CA2012/050926 filed Dec. 20, 2012, which are hereby incorporated herein by reference in its entirety.

FIELD OF THE INVENTION

This invention relates generally to lignocellulosic materials, and particularly to the making of paper while enhancing the properties thereof.

BACKGROUND ART

The manufacture of products from lignocellulosic natural polymer materials typically proceeds from a wet state through a moist state to a dry product. For the largest volume products made mainly from lignocellulosic materials, i.e. paper and paperboard, there have been numerous developments with the objective of improving the properties and reducing the cost of production. However these earlier developments for manufacturing paper have concerned major changes of the pressing process in the press section, or of the drying process in the dryer section, or of the calendering process in the calendering section. These major changes typically involve undesirable time and cost factors.

Therefore, there is a need for improved methods of processing lignocellulosic materials which overcome or reduce at least some of the above described problems.

Thus the present invention is not a water removal process, is not a drying process, is not a calendering process, being instead is a unique process which is not an element in current sheet or papermaking manufacturing processes. The present invention is a new process involving rapid warming of a moist sheet with the prime objective not for water removal, not for drying, not for calendering, but to improve properties of the material.

Processes for the manufacture of products incorporating lignocellulosic materials normally take place in equipment open to air. A fundamental characteristic is that the temperature of wet or moist material passing through equipment open to air must approach a dynamic equilibrium temperature termed the 'wet bulb temperature' or 'adiabatic saturation temperature'. For this reason, with the air conditions typical in the manufacture of products from lignocellulosic materials, the temperature for the wet or moist material in contact with air is therefore generally in the low range of about 40°-70° C.

SUMMARY OF THE INVENTION

The overall objective of this invention is to modify the micropore structure of the sheet, thereby improving properties and strength of the sheet while wet and/or when dry, properties which overall contribute to improved product quality and/or to enable reducing manufacturing cost.

By "properties" we mean mechanical (strength) properties of the sheet while wet and/or when dry, including tensile strength, burst strength, tear strength, compressive strength (short span compressive strength, ring crush strength, edgewise compressive strength), internal bond strength (thickness direction strength); barrier and flow resistance properties (reduced liquid penetration; air barrier resistance), dry paper surface properties such as decreased linting propensity; print quality and/or optical properties.

Thus according to one aspect of the present invention, there is provided a method of rapid warming of wet or moist lignocellulosic material including the steps of maintaining a moisture content which is in a range of above the fibre saturation point value of the lignocellulosic material and generally not lower than about 90% of this value, and increasing the temperature of the wet or moist lignocellulosic material to a level that components of the lignocellulosic material soften which results in improved properties of the lignocellulosic material.

The minimum value of material moisture content may also be described as the lower limit of about 0-0.1 kg water/kg dry below the fibre saturation point value.

The moisture content of the material can increase, remain unchanged or decrease to the minimum moisture content during the step of increasing the temperature. In a preferred application of the rapid sheet warming method the temperature would increase towards about 100° C. In a dynamic application the temperature increase from the low range of 40° C.-70° C. towards 100° C. may occur very rapidly, in times which may go down to about 0.1 second.

The components of the lignocellulosic material preferably include a natural polymer or a complex mixture of natural polymers.

An apparatus in accordance with a preferred embodiment of the present invention comprises a conveying device for advancing the lignocellulosic material, generally in sheet form to a temperature-increasing station, an energy flux inducing element at the temperature-increasing sheet warming station, an energy flux inducing element, while maintaining the moisture content above a minimum of about 90% of the fibre saturation point of the lignocellulosic material and a conveying device for advancing the sheet to the drying stage.

In a preferred embodiment, the energy flux inducing element is an electromagnetic thermal radiation emitter module. More particularly the electromagnetic emitter module may be infrared (IR). It is also contemplated that microwave energy may be used or other forms of suitable for energy transfer.

The lignocellulosic material may be maintained in a steam environment while the temperature of the material is being increased. Condensing saturated steam may also be used to warm the sheet rapidly, to increase the temperature of the wet or moist lignocellulosic material. Increasing the temperature of the lignocellulosic material can be facilitated by use of a sufficient energy flux by any suitable method known to persons skilled in the art The temperature of the wet or moist lignocellulosic material is increased towards or above the softening temperature of its polymer components for a time sufficient to soften the components of the lignocellulosic material. In a preferred embodiment this temperature may be up to about 100° C. This rapid sheet warming might be accomplished using several short bursts of the step of increasing the temperature of the wet or moist lignocellulosic material.

The lignocellulosic material may be paper or paper board.

Advantageously, existing apparatus and methods for processing of lignocellulosic materials, such as paper, may be modified in order to implement aspects of the present invention. The output of the lignocellulosic material processing, such as paper sheets made completely or partially from lignocellulosic materials, have improved properties which enable increased productivity, improved quality and reduced manufacturing costs.

While applying to the manufacture of paper and paperboard, which is the largest volume product made mainly from lignocellulosic components, the invention may apply also to products other than paper for which mainly lignocellulosic material proceeds from a wet state through a moist state during manufacture in a process open to air. These include lignocellulosic composite materials such as panels, using gypsum or the like as a binder, for use as a dry wall; lightweight lignocellulosic composite panels incorporating recycled newsprint used mainly in basements and between interior and exterior walls; lignocellulosic thermal insulation boards for example used between interior and exterior walls; lignocellulosic fibre boards for example used below the roof; and lignocellulosic corrosion inhibitor sheets. Any other products incorporating lignocellulosic material are included within the scope of the present invention.

BRIEF DESCRIPTION OF THE DRAWINGS

Further aspects and advantages of the present invention will become better understood with reference to the description in association with the following drawings in which.

DETAILED DESCRIPTION OF THE INVENTION

Figure 1:
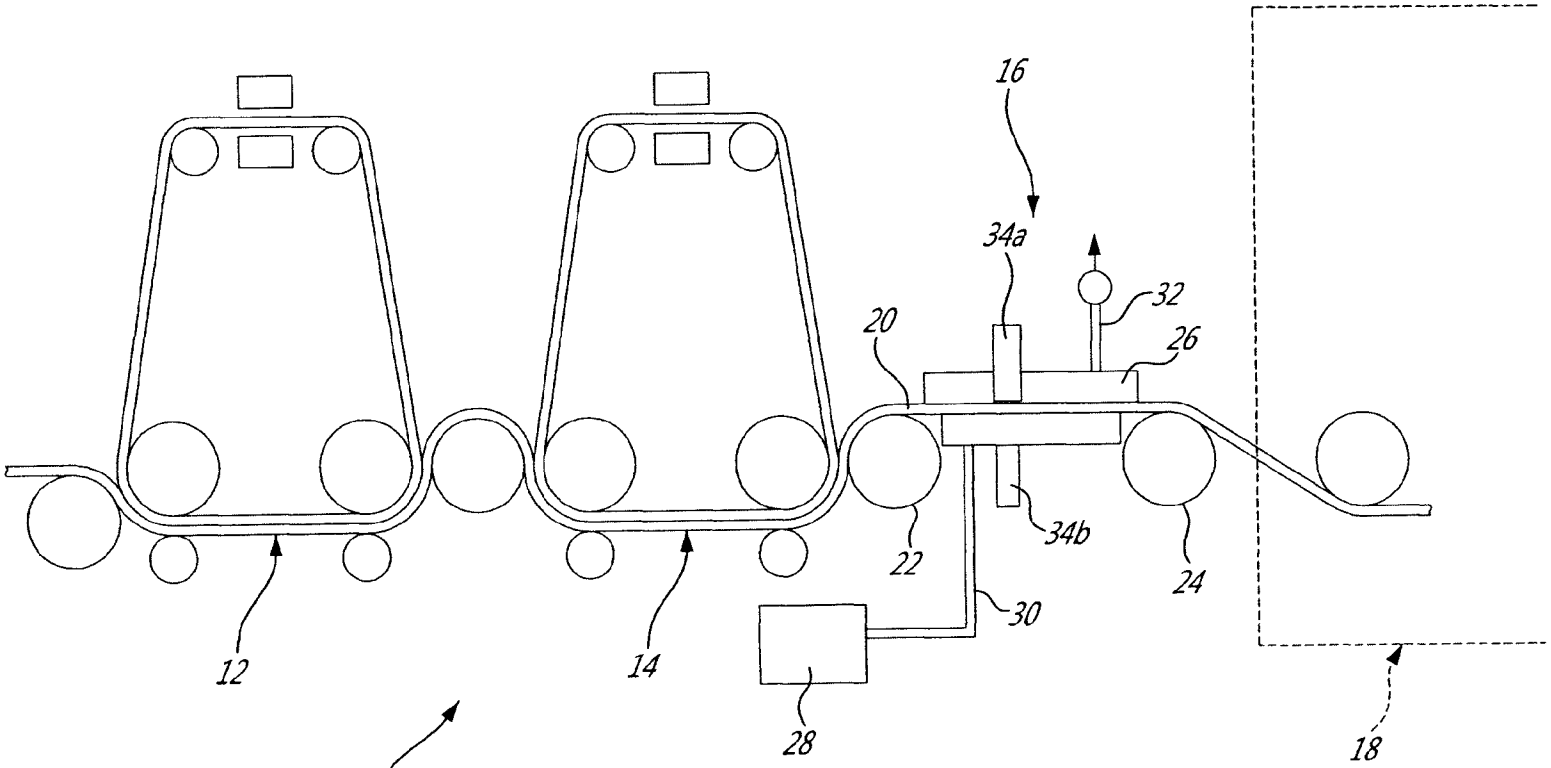
FIG. 1 is a schematic view of a portion of a paper machine showing an embodiment of the present invention.

On a typical papermaking machine, the wet or moist lignocellulosic material is open to air so that the material temperature approaches the wet bulb temperature which is a relatively low temperature. For conditions found in paper machines the wet bulb temperature in open air is typically in the 40° C.-70° C. range. At such low temperatures, typical of the range of wet bulb temperatures, some wet or moist lignocellulosic components such as the natural polymers remain relatively hard and rigid.

There is no unique temperature at which softening of the natural polymeric materials occurs. One reason for this is because the temperature for softening varies substantially between individual lignocellulosic natural polymers. In natural lignocellulosic material there is an unlimited range of composition of individual polymers possible, depending both on the source of the lignocellulosic material and on the processing that the material has experienced. Another source of variability in the temperature for softening of natural lignocellulosic material is that water acts to facilitate this change, hence the temperature for softening varies with moisture content of the material.

Therefore the properties of products from lignocellulosic materials depend on the extent to which, during the manufacture of such products, these natural lignocellulosic polymers were in a hard or rigid structure, or else in a softened state, which in turn depends on the temperatures existing when the material was in the wet or moist stage of manufacture. In the conventional processes, some of the lignocellulosic natural polymers remain in a hard or rigid state throughout the manufacturing process, placing a constraint on the quality of the product.

If has been found that if more of these natural polymers could be in a softened structure, then superior properties in both the wet and dry lignocellulosic material would result.

In one embodiment, electromagnetic energy emission is used to facilitate rapid warming the sheet, increasing the temperature of the wet or moist lignocellulosic material, and possibly, including carrying out this process in an environment of steam with or without the use of electromagnetic energy.

Thus use of electromagnetic energy emission, possibly in a steam environment, removes the constraint against increasing the temperature to above the wet bulb temperature of about 40°-70° C., as noted above. The warming of the sheet increases the temperature of the wet or moist material to a higher level at which the natural polymers of lignocellulosic materials will generally soften. This leads to improvement in properties of the material, providing the competitive edge of a better product quality while also enabling the reduction of the cost of products manufactured from mainly lignocellulosic materials by such strategies as reducing the basis weight or using a lower quality pulp furnish while at the same time maintaining the commercially required strength.

Products manufactured in forms such as sheets, webs, films, pads, blocks and rods, made completely or partially from lignocellulosic materials, may be treated, during the manufacture thereof by the present method.

Referring now to FIG. 1, there is shown the mid portion of a paper machine 10 having a wet press section including two web presses 12 and 14, upstream of the dryer section 18. In one embodiment, a temperature-increasing station 16 is shown between the web press section 14 and the dryer section 18. It is understood that the station 16 may be inserted before the press section or at some location within the dryer section 18. In a dynamic operation, the paper web 20 passes over a roll 22 into the temperature-increasing station 16 and exits over roll 24 into the dryer section 18. The web may pass through a steam box 26 in the station 16. However the steam box is optional. Steam is supplied to the steam box 26 from a steam generator 28 through lines 30. Infrared emitter modules **34*a* and 34*b* are mounted on either face of the web 20 and extend laterally of the web 20. The IR modules 34*a* and 34*b* are those supplied by Bekaert Solaronics of France. Two commercial IR modules from Bekaert are used, one on either side of the wet sheet or web 20**. Each can be about a 18 kW module providing an approximate combined power density of about 600 kW/m$^2$ emitted within the IR zone. Alternately, the rapid sheet warming could be from IR emitters on only one side of the sheet.

The maximum speed of the web 20 can be very fast, up towards the maximum speed of modern paper machines, allowing only a short timeline for the web 20 to pass through the IR emission zone. Typically the time of exposure to emission in the IR zone may be down to the order of 0.1 seconds.

It is important to maintain the web 20 in a wet or moist condition. As previously described the moisture content of the web 20 should be above the fibre saturation point and generally no less than 90% of the fibre saturation point. As shown in the present embodiment, the steam box 26 is provided with condensing steam to increase in temperature of the web 20 to a higher level at which the natural polymers of lignocellulosic materials will generally soften. As previously mentioned, the passing of the web 20 through the high intensity IR emission zone using standard commercial IR emission modules will, in an extremely short IR exposure time, raise the temperature of the web 20 to approach 100° C. Based on experiments, the combination of the moist web 20 and the increase of the temperature of the web 20 towards 100° C. will provide the significant improvements in diverse properties of the paper sheet.

The steam box 26, may, in an alternative arrangement, be placed upstream of the temperature—increasing station 16. Thus the moisture content of the web 20 can be increased prior to passing through the IR emission zone. Or, in another arrangement the moist sheet may be warmed rapidly by condensing steam without the use of electromagnetic energy emission.

Figure 2:
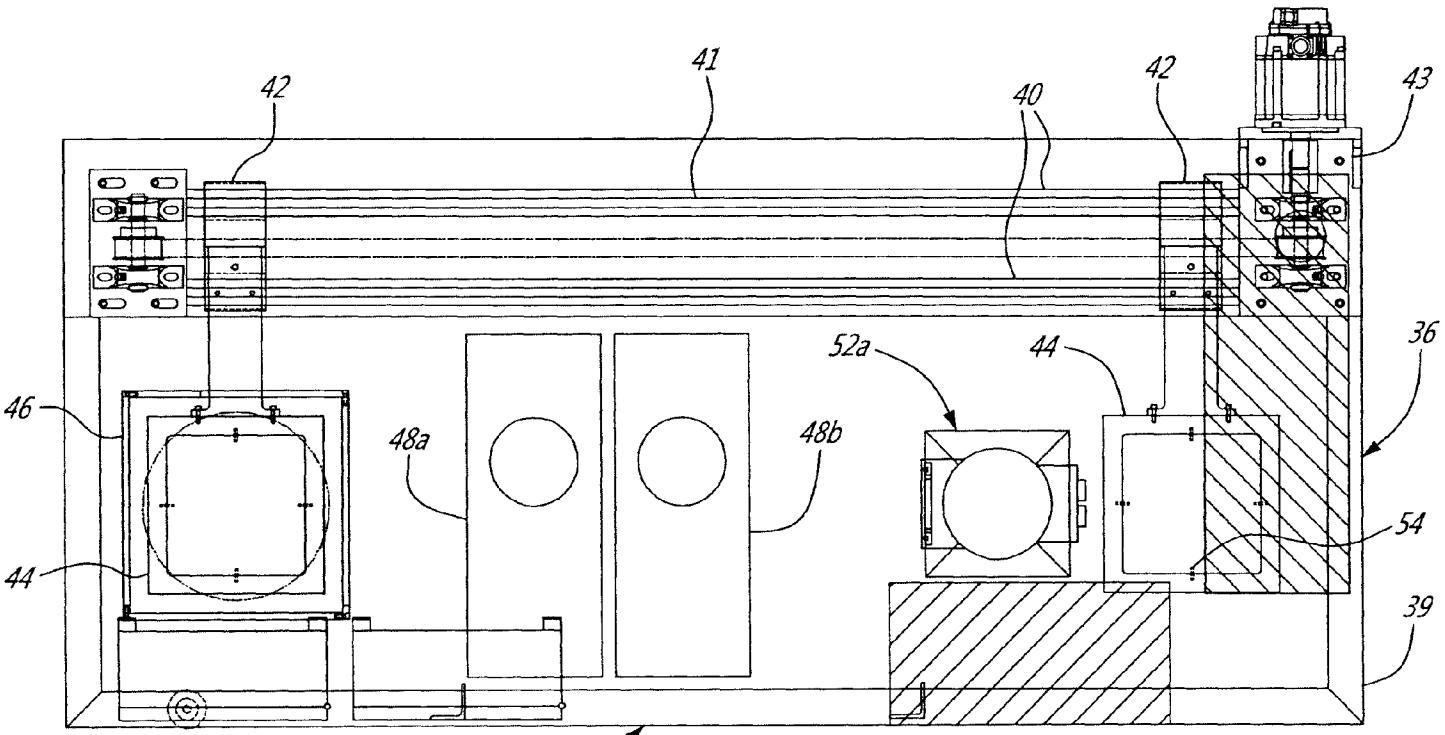
FIG. 2 is a top plan view of an embodiment of the present invention.
Figure 3:
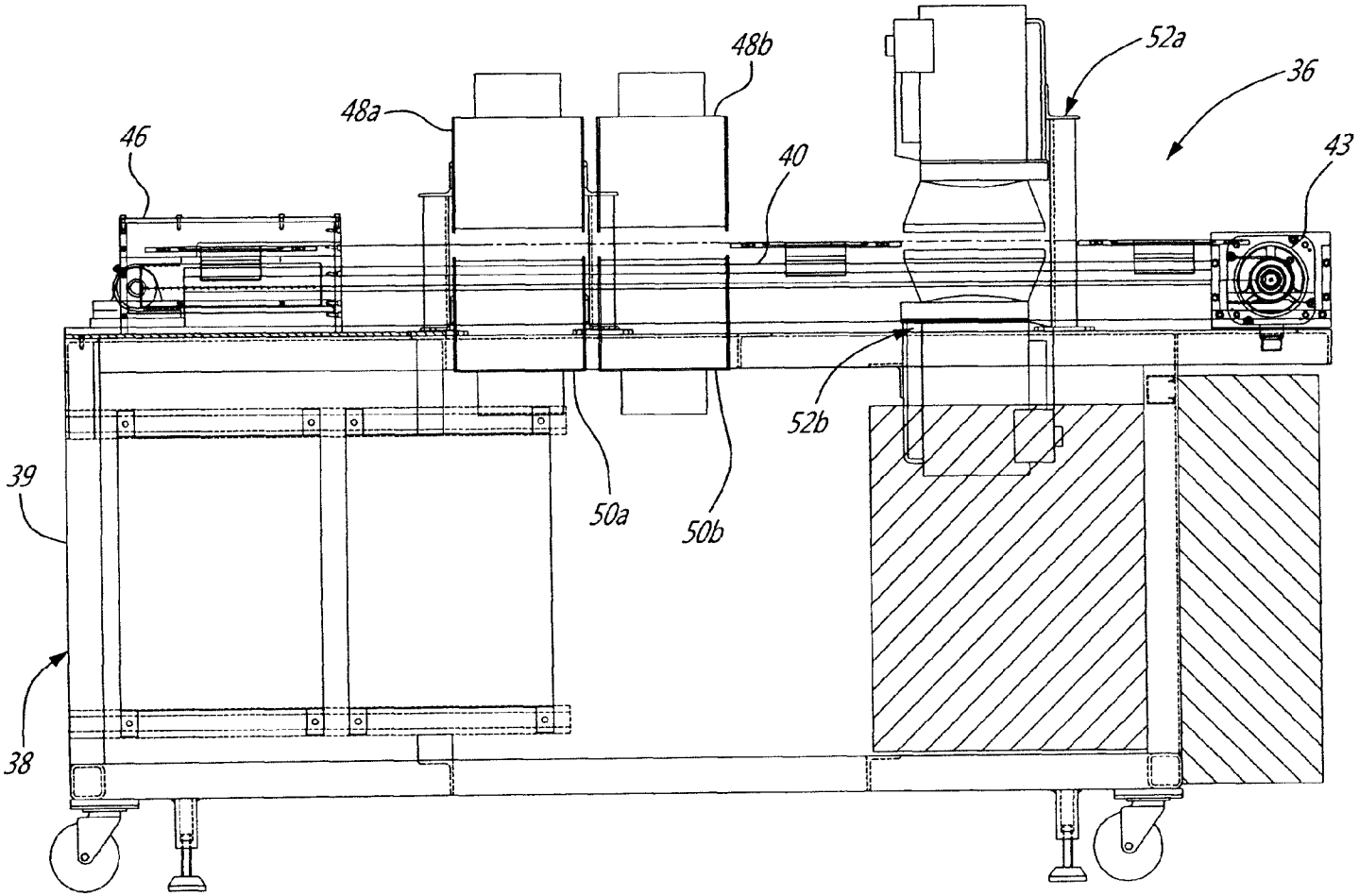
FIG. 3 is a side elevation of the embodiment shown in FIG. 2.
Figure 4:
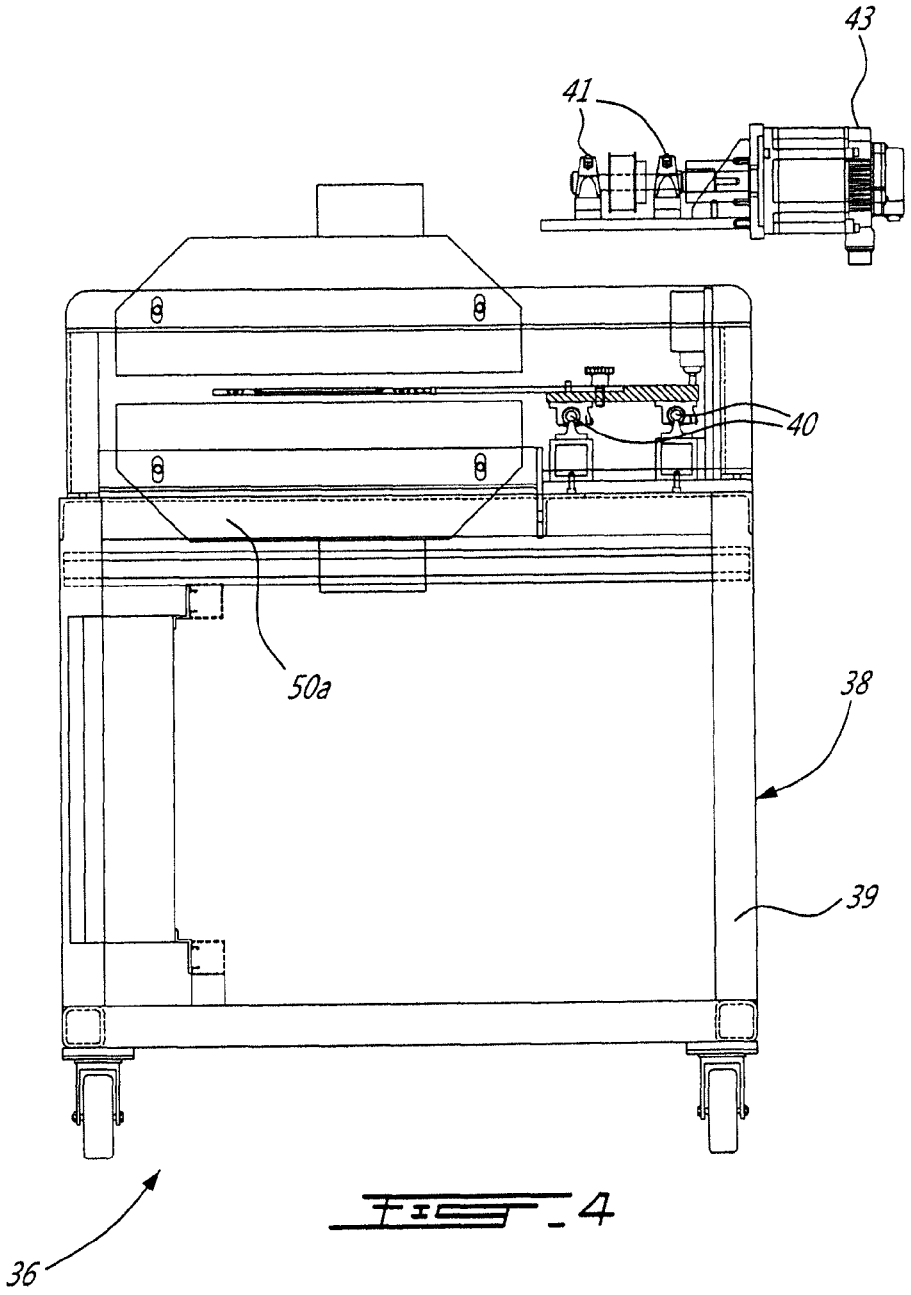
FIG. 4 is an end elevation of the embodiment shown in FIGS. 2 and 3.

FIGS. 2 to 4 represent a laboratory dynamic test facility set up to simulate the dynamic conditions in a paper machine.

The lab unit 36 for treating lignocellulosic material comprises a movable table 38 including a frame 39. A pair of rails 40 are shown mounted to the frame 39 to one side thereof. A conveyor 41, made up of a pair of straps, is moved by a powerful servo-electric motor drive 43. A carriage 42 is fixed to the conveyor cables and mounts a sheet frame 44 extending in cantilever fashion from the conveyor 41. The carriage 42, with the sheet frame 44 travels along a longitudinal axis relative to the table 38 in a horizontal path of travel.

At one end of the table shown on the left hand of FIGS. 2 and 3, is a humidity chamber 46 mounted to the frame 39. The humidity chamber 46 represents stage I in the description that follows. Downstream of the humidity chamber 46 is a pair of IR emission modules 48*a* and 50*a* mounted slightly out of the path of travel of the sheet frame 44 as will be described. A second pair of IR modules 48*b* and 50*b*, if needed, may be provided on the table 38 out of the path of travel of the sheet frame 44. The IR emissions modules represent stage II. The present invention relates to the rapid warming of the moist sheet which occurs in stage II.

Downstream of the IR modules is a pair of air blowers 52*a* and 52*b* located above and below the path of travel of the sheet frame 44. The pair of air blowers 52*a* and 52*b* represents stage III. Finally at the location 54, representing stage IV, the sheet may be removed from the sheet frame 44.

Stage I provides for the installation, in the sheet frame 44 of a sheet of specific basis weight and controlled moisture content. The sheet of a moist or wet lignocellulosic material was obtained, in a never-dried state, directly from a commercial production facility. At Stage I the sheet is installed in a humidity chamber 46 maintained with an atmosphere of saturated air at a controlled temperature of around 60° C., a temperature in the range existing in relevant sections of commercial paper machines.

The wet sheet is accelerated very rapidly from Stage I in order to achieve, after moving only about 20 cm, a steady high speed in the range of the speed of modern paper machines, which is then maintained constant while the sheet frame 44 carrying the wet sheet travels through the Stage II which represents the IR emission system, and is about 20 cm wide. Stage II comprises IR modules 48*a* and 50*a*, and possibly a second pair, 48*b* and 50*b*, on each side of the sheet which operate at controllable IR emission intensity. The IR modules used for the high intensity IR emission zone are standard industrial IR emission modules as previously mentioned in respect of FIG. 1. In Stage II the sheet temperature is thereby increased to approach 100° C. without significant evaporation during the very short IR exposure time. The short residence time for the sheet in the IR emission zone is controllable down to a minimum of about 0.08 s, a value corresponding approximately to the time available for exposure of the sheet to IR emission in commercial paper machines. The choice of about 100° C. is based on the confirmation obtained in our laboratory work, that with sheet moisture content sufficiently high relative to the 'fibre saturation point' of natural polymers in lignocellulosic materials, use of this temperature thereby enables better inter-fibre bonding & thereby, greatly improved properties of diverse kinds.

After exiting the Stage II the sheet frame 44 carrying the wet sheet, now at a temperature which may approach 100° C., is decelerated rapidly, similar to the acceleration from Stage I to Stage II, in order to stop in Stage III for a controllable time for drying. The stationary wet sheet is dried to commercial dryness in a time typical of that used in industrial paper machines, that is, in the order of a minute. The sheet temperature and moisture content are both monitored continuously by IR sensors from the moment of leaving Stage II to arrival in Stage III. Drying is achieved in the target time by a flow of hot air, from hot air blowers 52*a* and 52*b*, of controlled velocity and temperature impinging on both sides of the sheet.

After achieving a commercial level of dryness while stationary in Stage III, the sheet frame 44 carrying the dry sheet is carried about a further 25 cm and brought to rest in Stage IV. The sheet is then removed for determination of properties of commercial significance for the specific grade of lignocellulosic material being tested under the conditions used in Stage II.

The entire experimental facility, shown in FIGS. 2 through 4, is controlled and the relevant parameters recorded with a sophisticated data acquisition & control (DAQ) system. A user-friendly interface was developed using Labview software installed on a dedicated computer. The servo-motor, the drive for the linear motion system and the position in the linear motion system of the sheet frame 44 carrying the test sheet, were monitored. The temperature and moisture content of the wet sheet at Stage I, the emitting intensity level of the IR modules 48 and 50 of Stage II, and the evolution of both sheet temperature and sheet moisture content as well as the drying air temperature and flow rate of the forced-air dryer 52 of Stage III are all connected to Labview via the DAQ data acquisition system.

Figure 5:
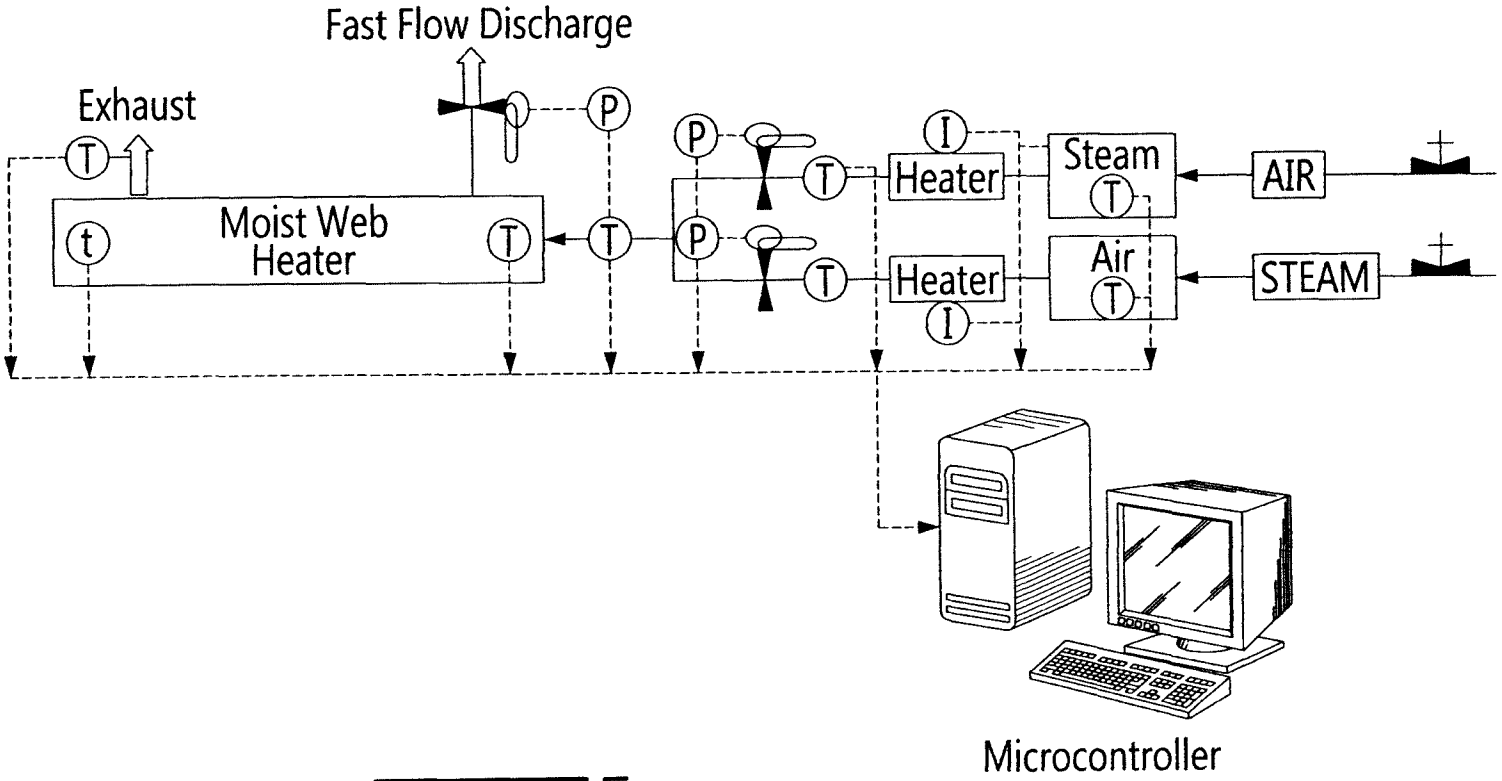
FIG. 5 is a schematic view of a process for increasing the temperature of the moist web, according to a second embodiment.

FIGS. 5 through 8 illustrate the increase in temperature of a wet or moist web of lignocellulosic material from rapid warming using only condensing steam. FIG. 5 is a schematic diagram illustrating a process for increasing the temperature of the moist web with condensing steam.

This embodiment shows a fixed steam press 54 having a closed vessel 58 to which a retractable restraint plate 60 is arranged. A sheet of paper 56 is generally placed on a fixed support plate 62 opposite retractable restraint plate 60 which secures the sheet 56 from above. As shown more clearly in FIG. 7, the slightly curved side of the closed metal vessel 58 functions as the sheet support surface 62 while being also a nozzle plate carrying an array of drilled holes of about 0.5 mm diameter, spaced about 0.6 mm apart. From this array of small nozzles there is a discharge alternately of: steam, for increasing the temperature of the moist sheet 56 by steam condensation, and warm air, used subsequently for drying the warm moist sheet 56. The sheet support nozzle plate 62 is about 30 cm across its curved dimension×50 cm long.

This closed vessel 58 which provides the sheet support is fitted with steam and air supply lines, along with automatic control valves enabling switching very quickly from contacting the paper first with condensing steam for increasing the temperature of the sheet then subsequently with air at 75° C. for drying the warm moist paper. The method of supplying this vessel 58 alternately with steam and air was designed to achieve complete transition very quickly from contacting the moist sheet 56 with condensing steam for increasing its temperature, to contacting it with warm air for drying the warm moist sheet 56. To achieve rapid transition from steam to air, inside this vessel 58, the discharge of steam or air occurs from a number of small distribution pipes 70, each with many small flow discharge holes.

The sheet support surface 62 could be covered with a choice of two porous, highly permeable materials—either a cotton pad 76, about 50 mm thick, or the flexible, porous metal plate 62 about 20 mm thick. Initially both alternatives were tested. The cotton pad 76, being more flexible than the metal porous sheet 62, was found to provide better contact with the paper and also to provide a smaller pore size for better local distribution of the steam and air flows through the moist sheet.

The sheet restraint plate 60 is a porous metal plate of dimensions matching those of the sheet support surface 62 that is about 30 cm across its curved dimension×50 cm long. Sheet restraint by a porous, highly permeable material was desired in order to facilitate both the flow of condensing steam through the sheet for increasing the temperature of the moist paper and the flow of air through the warm, moist sheet during drying, However, in order to avoid the paper sheet 56 from sticking to metal sheet restraint plate 60 a pad of dryer felt fabric 82 such as used in commercial paper machine cylinder dryer sections was used to cover the metal sheet. The objective of using the sheet restraint plate 60 was to maintain the sheet 56 under complete restraint during the drying, because paper strength properties differ significantly for drying with and without sheet restraint.

During the experiment:

Steam inlet temperature used: 106° C.

Paper specifications: The 60 g/m2 never-dried hand sheets, made from commercial thermo-mechanical pulp (TMP) recycled pulp, were 15 cm diameter Minimum time for condensing steam contacting the sheet: 0.9 s, including 0.4 s for closing-opening the retractable sheet restraint plate Time period for increasing the temperature of the moist sheet by contacting with condensing steam: From the minimum steam contacting period of 0.5 s±0.1 s, the time period for contacting the paper with steam could be increased in increments of 0.5 s Sheet initial temperature: about 45° C.

Tests were done to determine the time required in the oven for 60 g/m$^2$ sheets to reach 50° C. uniformly across the sheet thickness. Thus a 60 g/m$^2$ sheet consisting of 3 plies of 20 g/m$^2$ each was made with a bare thermocouple between each ply. Monitoring this 3-ply sheet during temperature equilibration in the oven established that 1 h was sufficient to obtain a satisfactorily uniform temperature.

For the minimum time required to remove the warm moist paper 56 from the oven, to place it on the support surface of the research steam iron press 58 and to close the retractable restraint plate 60 onto the sheet 56, thermocouple measurements of the surface temperature of the paper established that by the time the steam contact began, the sheet surface had cooled slightly, from 50° C. to about 45° C. The temperature of about 45° C. corresponds well to the objective of having the initial temperature of the test sheets in a similar range as the temperature of wet paper in commercial paper machines.

Other alternative methods were contemplated such as:

A. To increase the sheet temperature in the paper machine water drainage/water removal section. One technique of increasing sheet temperature is at the suction table and/or suction roll(s) through replacing some or all of the air flow through the sheet, customarily used to enhance water removal, by a flow of saturated steam which as it flows through the sheet condenses, thereby increasing the temperature of the sheet.

By increasing the temperature of the sheet with infra-red or by any other type of high energy flux sources such as microwave or other types of radiation source or any other suitable method of increasing the temperature of the wet or moist lignocellulosic material, possibly with raising the sheet temperature facilitated by maintaining the sheet in a steam environment to suppress evaporation. In this alternative, to generate just enough steam to maintain steam and eliminate air at the material surface to facilitate increasing the sheet temperature to the desired level.

B. The next alternative is to increase the sheet temperature at the sheet draws before and/or after the paper machine press section, or between the press rolls of press sections having multiple press rolls, while increasing the temperature of the wet sheet by contact with condensing steam. In this embodiment there could be a synergistic effect with further improvement of paper properties by raising the temperature of the sheet before or between the press rolls for such a superposition of effects.

Or increasing the temperature of the wet sheet by condensing steam replaced or supplemented by exposing the sheet to infra-red or by any other type of high energy flux sources such as microwave or other types of radiation or any other suitable method of increasing the temperature of the wet or moist lignocellulosic material, possibly with raising the sheet temperature facilitated by maintaining the sheet in a steam environment to suppress evaporation. Likewise, to facilitate increasing the sheet temperature to the desired level, is use of a sufficient energy flux by the radiation to generate just enough steam to maintain steam and eliminate air at the material surface.

C. Another alternative is to increase the sheet temperature at sheet draws entering the paper machine dryer section or in one or more of the draws or dryer pockets between adjacent drying cylinders within a cylinder dryer section, while exposing the moist sheet to contact with condensing steam which might be provided by steam boxes or similarly to the provision of pocket ventilation air in current commercial practice.

Or increasing the temperature of the moist sheet by condensing steam replaced or supplemented by exposing the sheet to infra-red or to any other type of high flux sources such as microwave or other types of radiation or any other suitable method of increasing the temperature of the wet or moist lignocellulosic material, possibly with raising the sheet temperature facilitated by maintaining the sheet in a steam environment to suppress evaporation. Likewise, to facilitate increasing the sheet temperature to the desired level an option which may be used is use of a sufficient energy flux by the radiation to generate just enough steam to maintain steam and eliminate air at the material surface.

D. Still another alternative is to increase the sheet temperature at one or more cylinders of a paper machine dryer section by exposing the moist sheet to quiescent condensing steam under a hood enclosing a cylinder, or with the moist sheet passing under an impingement or high velocity flow of condensing steam enclosed by a hood over one or more such dryer cylinders.

Or with increasing the temperature of the moist sheet by exposing the sheet to infra-red or by any other type of high energy flux sources such as microwave or other types of radiation source or any other suitable method of increasing the temperature of the wet or moist lignocellulosic material, possibly with raising the sheet temperature facilitated by maintaining the sheet in a steam environment to suppress evaporation. Likewise, to facilitate increasing the sheet temperature to the desired level an option which may be used is use of a sufficient energy flux by the radiation to generate just enough steam to maintain steam and eliminate air at the material surface.

E. Yet another alternative is to increase the sheet temperature in drying techniques other than the standard cylinder drying technique, such as in dryers employing high velocity air or air impingement, i.e. in Yankee dryers, in through air dryers (TAD), in IR and air flotation dryers of coated paper, by incorporating methods mentioned herein at appropriate locations.

F. A further alternative is to increase the sheet temperature in a paper machine by passing the sheet over one or more perforated or porous cylinder(s) or sheet support(s), analogous to a through-air dryer (TAD), but with the increase in the temperature of the moist sheet obtained by the through flow being condensing steam instead of hot air as is used in current industrial practice.

Any multiple use or combination of use of the above alternatives might be considered to be applied in a paper machine or independent from a paper machine.

For lignocellulosic products, other than paper, the optimum procedures would be conditioned by characteristics including the shape, form and use of these products as well as by the specific process techniques appropriate for manufacturing each product. For such products the general strategy outlined here applies, with modification of implementation procedures to achieve bringing relevant natural lignocellulosic components to temperatures above their softening temperature for the short time required for more of these components to be in a softened state leading to improved product quality.

Experiments with Static Test Facility

This set of demonstration tests was carried out using paper, as the largest volume lignocellulosic product, at 6 levels of moisture content over the range 0.8 to 1.4±0.1 kg water/kg dry sheet. The upper values of these levels of paper moisture content could relate to the above mentioned alternative B, applicable at the sheet draws around the paper machine press section, including the draw between the press and dryer sections, while the lower of these moisture content levels could relate to alternative C. However, since water removal is not required at this stage, these demonstration tests are unrelated to the great number of existing pressing processes.

The objective of these demonstration tests was to determine the extent of the improved properties of paper which results when paper at moisture content "X", near or above the fibre saturation point moisture content, $X_{fsp}$, is brought quickly and for a sufficient time to a temperatures high enough to enable more of the lignocellulosic polymers to be in a softened structure rather than a hard state. Because of the complexity of the molecular structure of large number of individual natural polymers found in lignocellulosic materials the relevant temperature is not a single temperature but extends over a temperature range which is also dependent on sheet moisture content.

In order to determine the extent of improvement in properties of paper which results from these tests, after the temperature of the moist sheet has been increased rapidly, the warm sheet is then dried. The drying is carried out in an environment in which the paper experiences conditions similar to that for drying paper in commercial paper machines.

Demonstration Tests: The 4-Step Strategy (1) Establishment of Initial Temperature & Initial Moisture Content of the Paper For moisture content of the test sheets of paper, these sheets were conditioned to the 6 levels of moisture content recorded above, which range from slightly below to significantly above that of the fibre saturation point moisture content, $X_{fsp}$, of the type of paper used, i.e. with $X>X_{fsp}$. For the paper tested, never-dried hand sheets made from thermomechanical pulp (TMP), the $X_{fsp}$ value was determined to be 0.89 kg water/kg dry sheet.

For initial temperature of the test sheets, the choice derives from the fact that in commercial paper machines the temperature of the sheet while wet or moist can be in the range somewhat above about 40° C. Therefore in these demonstration tests an initial sheet temperature in this range was used. Thus prior to use the moist sheets were equilibrated in an oven at 50° C., which enabled the tests to start with the moist sheet at about 45° C.

(2) Paper Temperature-Increase Step

The temperature of the moist sheet, T, was increased quickly from 45° C. by direct contact with saturated steam at 1 atm and slightly above 100° C., condensing on the sheet for precisely controlled short periods of time in the range 0.5 s to longer.

(3) Paper Drying Step

To obtain dry sheets for determination of properties of dry paper, immediately after the end of the temperature increasing step (2), the warm moist sheet was dried under restraint in air at 75° C. so that the sheet temperature while drying corresponds approximately to the range which applies for the moist sheet in the dryer section of a commercial paper machine.

(4) Paper Property Determination

In the final step, selected properties of the dry paper were determined.

Demonstration Tests: Specifications of the Test Facility

Figure 6:
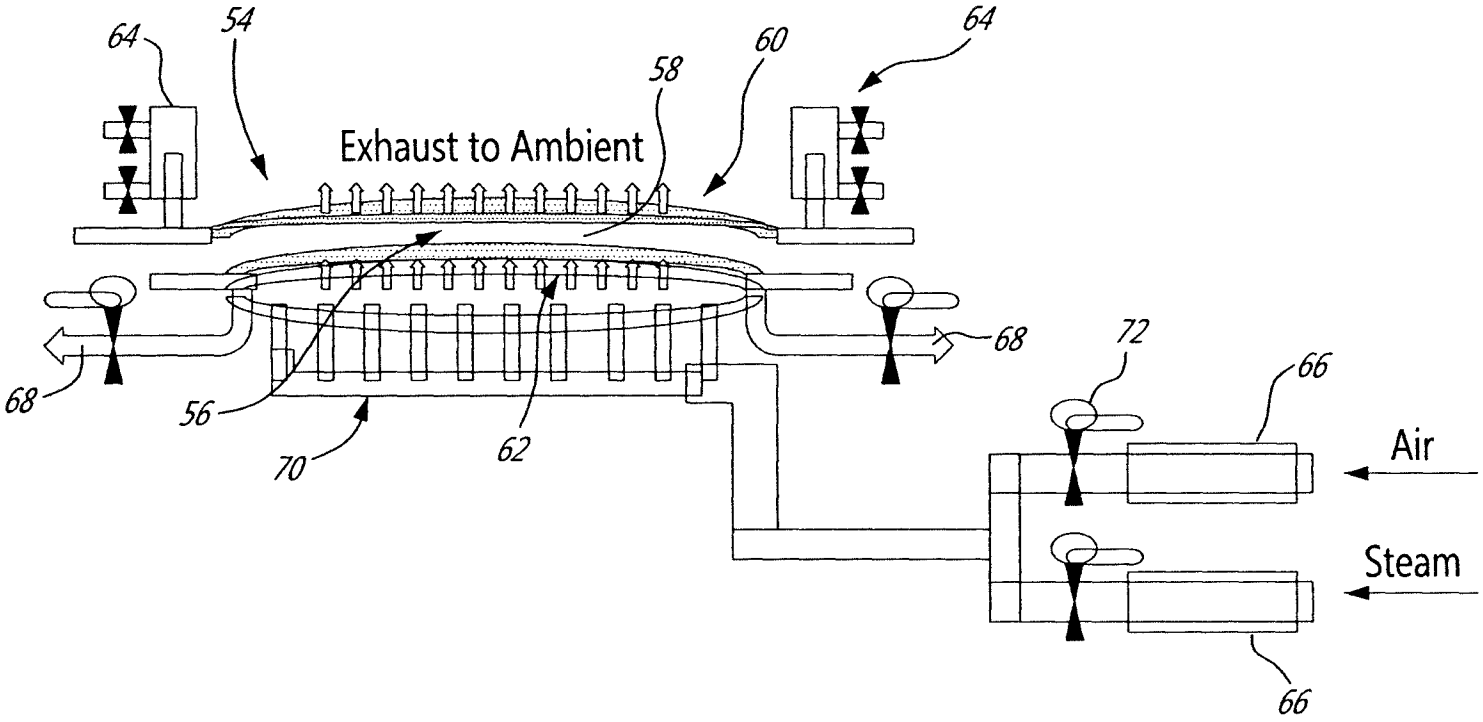
FIG. 6 is a schematic lateral cross section of a detail of the embodiment shown in FIG. 5.

The test facility provided two functions—first contacting the moist sheet with condensing steam to increase its temperature in accordance with this invention, then contacting it with air for drying the warm, moist paper in a step not related to this invention. FIGS. 5 and 6 provide schematic representations of, respectively, the process for increasing the temperature of the moist web, and the equipment for increasing the temperature of the moist web, which was previously described.

Demonstration Test: Test Procedure

For making the hand sheets, Canadian Pulp & Paper Association (CPPA) standard methods were used.

For Step 1, several operations were required, as follows:

To reach target sheet moisture content, X, water was sprayed on the sheet and the moisture content determined gravimetrically.

These moistened sheets were kept for more than 24 h in a sealed plastic bag in a condition-controlled room to allow complete equilibration of moisture content.

Just before the tests, the precise sheet moisture content, X, was determined gravimetrically.

Prior to placing the moist sheet in position for increasing its temperature by contacting with steam condensing at 1 atm, the steam entering at 106° C. was opened to the sheet support vessel so that, with steam discharging from the array of multiple nozzles, this sheet support surface came to 106° C. prior to coming in contact with the moist sheet.

In preparation for Step 2 of the 4-Step test strategy, in the steam-air contacting apparatus the moist sheet was placed on the cotton pad 76 covering the sheet support surface 62 and tightly secured by the retractable sheet restraint plate 60 (covered with dryer felt 82) so as to have complete restraint of the paper during the subsequent drying stage.

For Step 2, the temperature of the tightly secured moist sheet was increased from 45° C. by steam condensing at 1 atm and 100° C. on the moist sheet for predetermined short time intervals in the range from a minimum of about 0.9 s (about 0.5 s+about 0.4 s for closing and opening the retractable sheet restraint plate 60) up to 7 s. As detailed earlier, steam contact of the sheet was aided by the retractable sheet restraint plate 60 being permeable, hence enabling steam flow through the sheet and this restraint plate 60. The period of contacting with condensing steam was terminated by switching the supply to the sheet support vessel 58 from steam to 75° C. air.

For Step 3, Drying: while the warm, moist sheets from Step 2 remained in place and undisturbed in this contacting apparatus, the sheets were dried with 75° C. air to a final moisture content X of 5-6% as is typical for commercial papermaking. To ensure that switching from steam to hot air, to go from Step 2 to Step 3, is achieved with minimal mixing of air and steam during this transition, a pair of solenoid valves 72 were installed on both sides of the fixed support plate 62. Opening these solenoid valves 72 during the transition period enabled discharging almost simultaneously the steam remaining within the pipes and the flow distributor of this plate.

Drying time in 75° C. air was 30 s-40 s. Because the strength properties of dry paper are increased by the sheet being restrained during drying it is important to note that in demonstration tests the sheets were dried under restraint. Measurement of sheet dimensions before and after drying confirmed that total restraint was in fact achieved.

For Step 4, Property Determination, the properties specified below were determined for the dry paper.

For comparison of the properties of dry paper produced without increasing the temperature of the moist sheet with steam, i.e. without Step 2, some test sheets were subjected to just experimental Steps 1-3-4. Thus without using the Step 2 stage of increasing the sheet temperature in condensing steam such comparison sheets were directly dried from the same moisture content using the same apparatus with contacting only for drying with air at 75° C.

The 15-20 sheets used for replicate experiments for each set of operating conditions gave 15-20 sheets for strength determinations.

Paper strength properties: Two commercially important strength properties were determined:

Tensile Index

Tensile Energy Absorption (TEA). Determination of Tensile Energy Absorption requires determination also of Breaking Length.

Demonstration Tests: Record of Results

With determination also of the same properties of dry paper produced without increasing the temperature of the moist sheet with steam, i.e. without Step 2, the paper properties for this base case were established for all test conditions. This procedure enabled reporting of all results below on a basis relative to a sheet produced without use of the key step of increasing the temperature of the moist sheet from 45° C. Thus all results can be presented directly as "relative" improvement in strength, i.e. as % improvement in strength relative to the base case of the technique of this invention not being used.

TABLE 1

1: Tensile Strength results
Improvement of Tensile Strength, %:
{(Tensile Index, with temperature increase) − (Tensile Index, without temperature increase)}/(Tensile Index, without temperature increase)

| $X_o$ kg water/ kg dry fibre | Time for increasing paper temperature, s | | | | | |
|---|---|---|---|---|---|---|
| | 0.5 | 1 | 2 | 3 | 5 | 7 |
| 1.4 | NO | NO | 3 ± 1.5% | 6 ± 2% | 30 ± 3% | 31 ± 3% |
| 1.2 | NO | NO | 3 ± 1% | 6 ± 3% | 30 ± 3% | 31 ± 3% |
| 1.1 | NO | NO | NO | 6 ± 2% | 30 ± 3% | 30 ± 3% |
| 1 | NO | NO | NO | 5 ± 2% | 29 ± 2% | 30 ± 3% |
| 0.9 | NO | NO | NO | NO | 8 ± 2.5% | 9 ± 2% |
| 0.8 | NO | NO | NO | NO | NO | NO |

NO: signifies less than 2% strength enhancement

TABLE 2

2: Tensile Energy Absorption, TEA, results
Improvement of TEA Strength, %:
{(TEA, with temperature increase) − (TEA, without temperature increase)}/(TEA, without temperature increase)

| $X_o$ kg water/ kg dry fibre | Time for increasing paper temperature, s | | | | | |
|---|---|---|---|---|---|---|
| | 0.5 | 1 | 2 | 3 | 5 | 7 |
| 1.4 | NO | NO | 3 ± 1.5% | 4 ± 1.5% | 22 ± 3% | 24 ± 4% |
| 1.2 | NO | NO | 2.5 ± 1% | 4 ± 2% | 23 ± 3% | 23 ± 3% |
| 1.1 | NO | NO | NO | 3 ± 1% | 20 ± 3% | 18 ± 3% |
| 1 | NO | NO | NO | 3 ± 1.5% | 17 ± 3% | 19 ± 2% |

TABLE 2-continued

| 2: Tensile Energy Absorption, TEA, results Improvement of TEA Strength, %: {(TEA, with temperature increase) − (TEA, without temperature increase)}/(TEA, without temperature increase) | | | | | | |
|---|---|---|---|---|---|---|
| $X_o$ kg water/ kg dry | Time for increasing paper temperature, s | | | | | |
| fibre | 0.5 | 1 | 2 | 3 | 5 | 7 |
| 0.9 | NO | NO | NO | NO | 10 ± 2% | 11 ± 2% |
| 0.8 | NO | NO | NO | NO | NO | NO |

NO: signifies less than 2% strength enhancement

Demonstration Tests: Observations

1. For both Tensile Strength and Tensile Energy Absorption (TEA), at any moisture content tested, the increase in temperature provided by time of contacting in condensing steam of 0.5 s and 1 s was not sufficient to achieve any significant strength enhancement.

2. The strength improvement results were as follows:

2a. With moisture content, X, of 1.2-1.4 kg water/kg dry sheet, the increase in temperature from 45° C. provided by 2 s contact time with condensing steam was sufficient to achieve about 3% strength improvement, but no significant strength improvement was obtained for lower values of moisture content, X, in the range 0.8-1.1 kg water/kg dry sheet.

2b. As the contact time with condensing steam was increased to 3 s & 5 s, significant strength improvement was obtained at correspondingly lower values of moisture content, X, of 1.0 and 0.9 kg water/kg dry sheet. However for the lowest value of moisture content tested, 0.8 kg water/kg dry sheet, no significant strength improvement was achieved even for the longest contact time used with condensing steam, 7 s.

2c. Strength improvement increases with increasing contact time with condensing steam up to about 5 s but the use of the longer time of 7 s produces little or no further increase in strength improvement. This characteristic of reaching a strength improvement plateau at condensing steam contacting time of 5 s or longer was found for all values of moisture content, X, over the range 1.4 down to 0.9 kg water/kg dry sheet.

2d. The plateau value of strength improvement for 5 s-7 s condensing steam contacting time was unchanged as sheet moisture content was decreased from the maximum value tested, 1.4, down to 1.2 kg water/kg dry sheet. This maximum level of strength improvement was about 31% for Tensile Strength, about 24% for TEA. As sheet moisture content was decreased further, to 1.1 and 1.0 kg water/kg dry sheet, the plateau value improvement in TEA was reduced slightly but that for Tensile Strength remained essentially unchanged. As sheet moisture content was decreased further yet, to 1.0 and 0.9 kg water/kg dry sheet, the plateau value improvement in both Tensile Strength and TEA decreased to the range 8-11% strength increase.

Demonstration Tests: Analysis of Results

Figure 9:
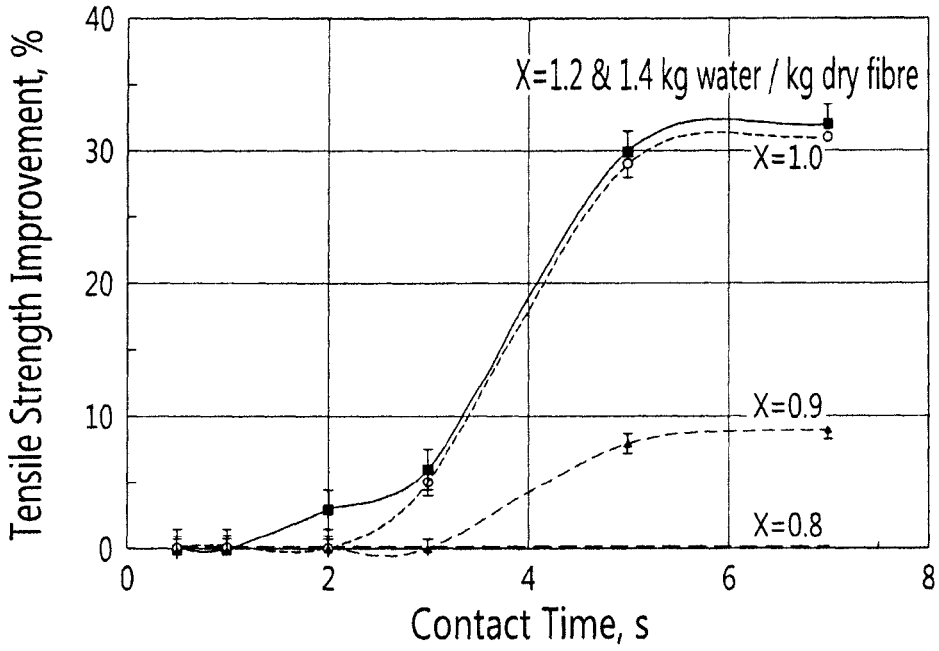
FIG. 9 is a graphical representation of the effect of steam contacting time and paper moisture content on tensile strength improvement, according to the embodiment shown in FIGS. 5-8.
Figure 10:
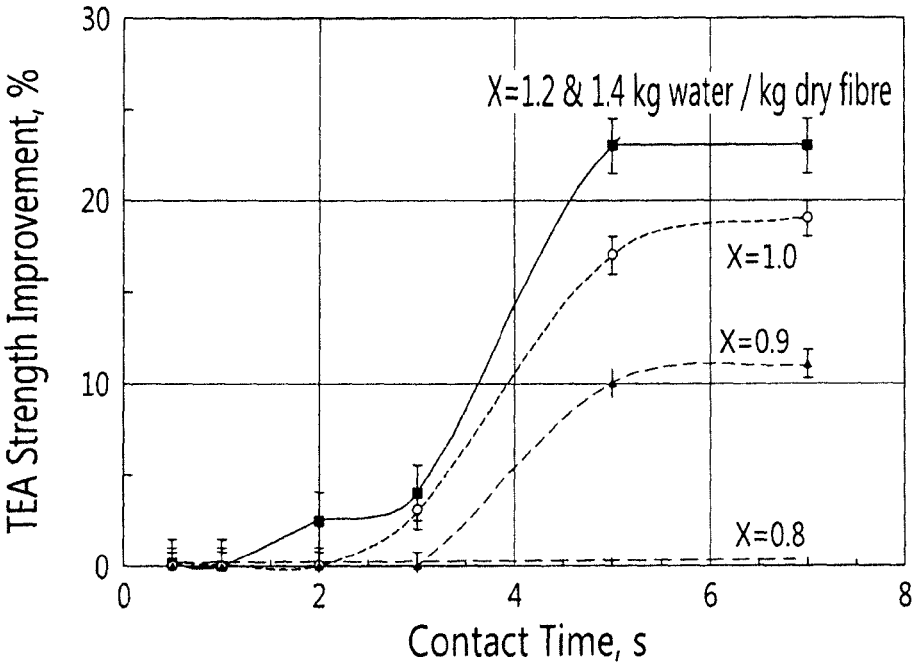
FIG. 10 is a graphical representation of the effect of steam contacting time and paper moisture content on Tensile Energy Absorption (TEA) strength improvement, according to the embodiment shown in FIGS. 5-8.
Figure 11:
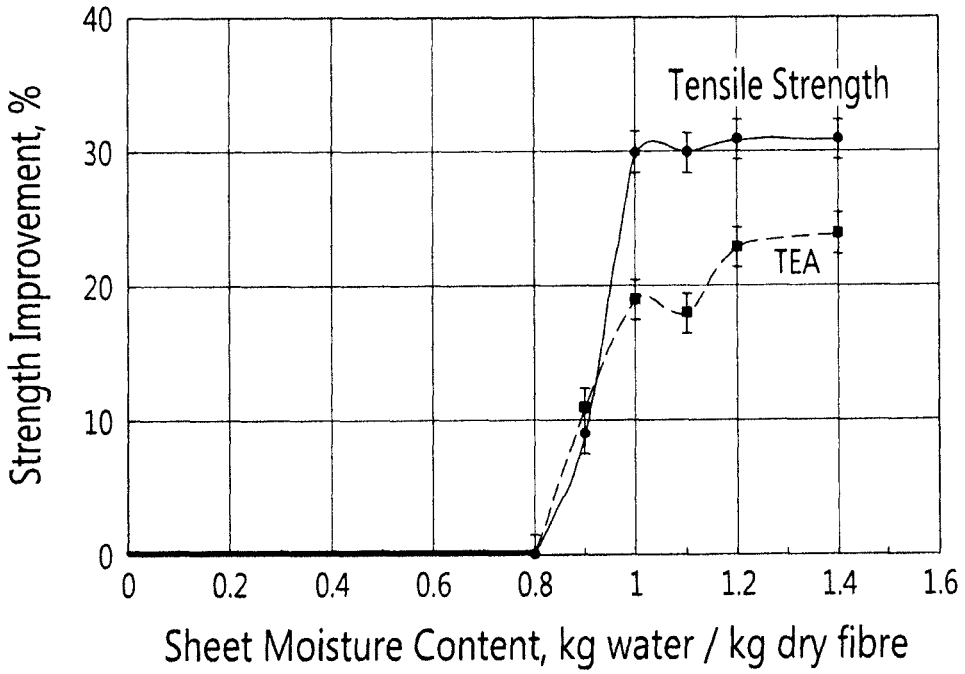
FIG. 11 is a graphical representation of the effect of sheet moisture content on the maximum value of strength improvement, according to the embodiment shown in FIGS. 5-8.

For the results shown in Tables 1 and 2, an analysis is facilitated by representing these measurements graphically in FIGS. 9, 10 and 11. First, FIGS. 9 and 10 present strength improvement as a function of time of increasing the moist paper temperature from 45° C. by contacting with steam condensing at 100° C., with parameters of paper moisture content at three of the levels within the full range investigated, 0.8-1.4 kg water/kg dry sheet. The results in Tables 1 and 2 show that for both strength properties determined, Tensile Strength and Tensile Energy Absorption, there is no significant difference between the strength improvement at the 2 highest values used for paper moisture content, 1.2 and 1.4 kg water/kg dry sheet. Therefore in FIGS. 9 and 10 the results at those high moisture contents are shown as a single line. In the design of these demonstration tests for the improvement of paper properties, FIGS. 9 and 10 highlight the interaction between the test parameters of paper moisture content, X, and time, t, for contacting paper in condensing steam to increase the temperature of the moist sheet. For these tests the key temperatures were:

(i) initial temperature of the paper, fixed for these tests at about 45° C. to correspond approximately to conditions in a paper machine, (ii) maximum paper temperature of 100° C. that is possible with use of contacting the paper with condensing steam at atmospheric pressure.

As water facilitates conversion of lignocellulosic components from a hard state to a softened structure, a higher value of moisture content favors this conversion, hence favors strength improvement. Reaching a higher sheet temperature also favors this conversion, hence also favors strength improvement. But as these invention demonstration tests were carried out with fixed conditions for increasing the sheet temperature, it follows that the higher the sheet moisture content, the greater the mass of sheet to be heated, hence the lower the final sheet temperature reached for any specific steam contacting time until the maximum temperature of 100° C. is reached.

The results correspond well to the expected interaction between the test parameters of paper temperature-paper moisture content-time in the (T-X-t) history of the test sheets. FIGS. 9 and 10 show that the lower the moisture content, the slower is the strength improvement, and the less complete is the strength improvement at long contacting time. This behaviour applies only above a limiting low value of moisture content, X, in the range between 0.8 and 0.9 kg water/kg dry fibre for this particular type of paper made from thermomechanical pulp (TMP). The characteristic of no improvement of paper properties whatever for moisture content below this limit is seen to apply even at the longest time of contact with atmospheric pressure-steam in spite of the fact that this would bring the temperature of the moist paper up closer to the advantageous limit of 100° C. With the fibre saturation point, $X_{fsp}$, of 0.89 kg water/kg dry sheet for the paper used, the measurements show only a moderate strength improvement (about 8-11%) for a sheet moisture content of 0.9 kg water/kg dry sheet at even the longest values of steam contacting time used, t of 5 s and 7 s, at which paper temperature would have reached 100° C.

As is apparent from FIGS. 5 and 6, for the upper limit of paper moisture content investigated (X of 1.2 and 1.4 kg water/kg dry sheet) the minimum contacting time in condensing steam for strength improvement to start is about 2 s, with this minimum time for strength improvement increasing as moisture content decreases.

Figure 7:
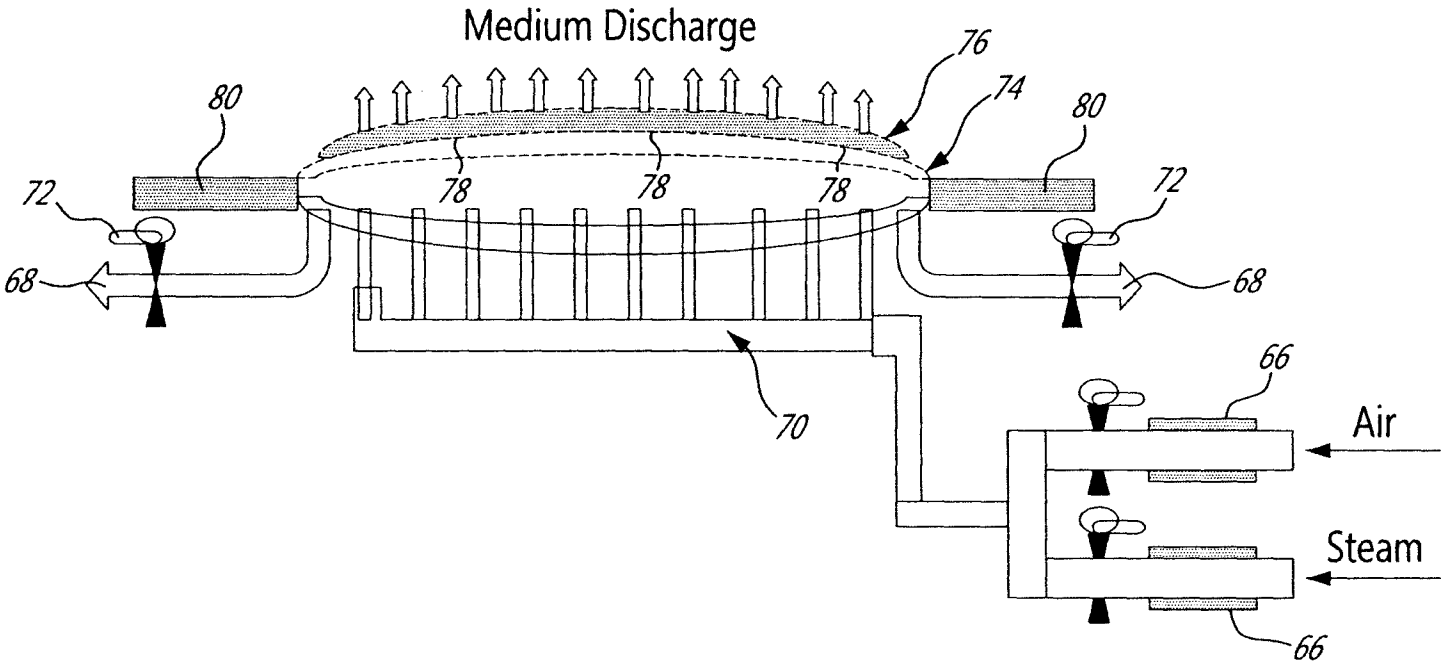
FIG. 7 is a schematic lateral cross section similar to FIG. 5, of a further detail.
Figure 8:
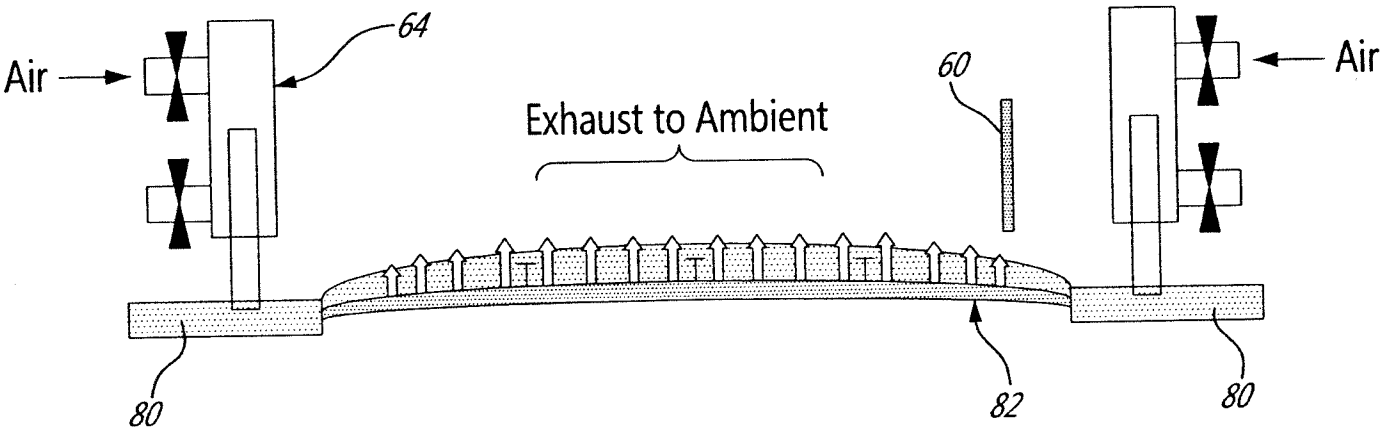
FIG. 8 is a schematic view lateral cross section similar to FIG. 5 of a further detail.

The existence of a maximum level of strength improvement, apparent on FIGS. 5 and 6 from the plateau reached at higher values of steam contacting time, is examined further with the results as shown in FIG. 7 for the effect of paper moisture content on the limiting values of strength improvement at the upper limit of contacting time in steam, 7 s. FIG. 7 shows that as a function of paper moisture content, the system is characterized by two limiting plateau values for strength improvement for paper held at 100° C. The lower limit of no strength improvement applies for all moisture contents below some value between about 0.8 and 0.9 kg water/kg dry sheet for the specific grade of paper used for these tests. For this specific grade of paper the crucially important upper limit of maximum strength improvement for paper held at 100° C. applies for all moisture contents above a value of about 1.1 kg water/kg dry sheet according to the results for Tensile Strength, above about 1.2 kg water/kg dry sheet as indicated by the results for TEA.

The results for both strength properties for this specific grade of paper brought to approach 100° C. show perfect consistency in identifying the value of the lower limit of no strength improvement, a value between 0.8 and 0.9 kg water/kg dry sheet, and likewise that the moisture content required for maximum strength improvement is in the narrow range of 1.2-1.3 kg water/kg dry sheet. Another important condition concerning the results as represented on FIG. 7 is that, with the long time of contacting with condensing steam, all the data shown on FIG. 7 for maximum strength improvement are with paper temperature at the advantageous level of 100° C.

For the broader application of the results from these specific demonstration tests it should be recalled that for the paper used here the value of the fibre saturation point, $X_{fsp}$, was 0.89 kg water/kg dry sheet. Thus for paper which is held at around 100° C. the above findings from FIG. 7 may be expressed more generally as:

(1) the lower limit of paper moisture content below which no strength improvement can be obtained is some value below the fibre saturation point value, $X_{fsp}$, by only about 0 to 0.1 kg water/kg dry sheet, and (2) the upper limit for which strength improvement cannot be increased further by increasing paper moisture content further is some value above the fibre saturation point value, $X_{fsp}$, by about 0.3 to 0.5 kg water/kg dry sheet, a moisture content level which gives the maximum strength improvement. This technology continues to work at higher levels of moisture content but the beneficial effect obtained would not be greater than this maximum strength improvement.

The action of water in aiding the conversion of lignocellulosic components from the hard state to softened structure which enables paper strength improvement is thus shown by these demonstration results to be a complex role.

The present demonstration tests therefore establish two important limits for commercial application of this technology: (1) that implementation should be avoided in the paper moisture content region which is below $X_{fsp}$ by more than the small amount of about 0-0.1 kg water/kg dry because no strength improvement would be obtained even for paper brought to 100° C., and (2) that the maximum strength enhancement for paper held at about 100° C. cannot be further improved by increasing paper moisture content above $X_{fsp}$ by more than about 0.3 to 0.5 kg water/kg dry.

Three of the results for the limiting values of strength improvement obtained in these demonstration tests have great practical significance for industrial implementation of this new technology.

a) To have established that at a moisture content below $X_{fsp}$ by only the small amount of about 0-0.1 kg water/kg dry, no improvement of paper properties would be obtained even if the moist paper is brought to a temperature of 100° C. is important because this lower limit of moisture content establishes where implementation effort should not be expended.

b) It is likewise essential information for industrial implementation to have determined that although higher moisture content aids the improvement of strength in the lower range of moisture content, there is a relatively low limit for this beneficial effect. Thus for holding the sheet at a temperature of about 100° C., to achieve the maximum possible improvement in these two strength properties it is sufficient to have a moisture content only about 0.3-0.5 kg water/kg dry sheet greater than the fibre saturation point value. The technology works at higher levels of moisture content but the beneficial effect obtained would not be greater than this maximum strength improvement.

3. As the maximum possible strength improvement is the driving force for commercial adoption of this invention, the most significant outcome from these demonstration tests is to reveal that strength improvement at the impressive levels of 31% and 24% stronger is obtained for, respectively, Tensile Strength and Tensile Energy Absorption, TEA.

By contrast to the great industrial significance for the three characteristics listed above there is little significance to the values determined here and shown on FIGS. 9 and 10 for the time of increasing paper temperature by the specific technique used for these tests, that is, by contacting the sheet with steam condensing at 100° C. As previously mentioned, there are numerous methods more effective than that used in these demonstration tests for bringing paper temperature to the levels at which property improvement occurs.

An important quality of the sets of values of:

'maximum strength improvement'–'paper moisture content above $X_{fsp}$' is that the validity of the above limits is not limited to the conditions of these demonstration tests but relate to fundamental characteristics which apply generally.

Demonstration Tests: Summary and Conclusions

1. Objective of the Demonstration Tests

The objectives were to determine the extent of improvement in key strength properties of paper which results from increasing the temperature of moist paper quickly from 45° C. by use of just one specific technique, contacting the sheet with steam condensing at 100° C., and to determine the relation of paper moisture content to this strength improvement.

2. Design for the Tests

In a test program using a research steam iron press facility with precision instrumentation and controls, the temperature of paper was increased by condensation of essentially saturated atmospheric pressure steam for a range short contact times.

Paper strength improvement was determined for 'Never-dried, TMP handsheets with fibre saturation point moisture content of 0.89 kg water/kg dry sheet, having basis weight 60 g/m$^2$.

The initial temperature of the paper was 45° C., a temperature in the range for sheets in commercial paper machines.

The effectiveness of this invention was tested for paper at 6 levels of moisture content over the range from 1.4 down to 0.8 kg water/kg dry sheet, and for time of increasing the temperature of moist paper by contacting in condensing steam at 6 values over the range 0.5 s-7 s.

With use of all 6 levels of moisture content with all 6 values of time of contacting in condensing steam, 36 sets of test conditions were used. For each test condition, 15-20 replicate tests gave 15-20 sheets for determination of each strength property.

Two commercially important, standard paper strength properties were determined:

Tensile Index

Tensile Energy Absorption (TEA), which requires determination also of Breaking Length.

The procedure of 15-20 replicates for each test condition provided high precision for the strength determinations, in the range ±1% to +3% of the reported value. With 2 strength properties determined for each of the 36 test conditions, 72 average values of strength properties were determined for each test condition. With 15-20 replicates for each condition, the overall results rest on a substantial test program involving 72 conditions investigated and about 1300 determinations of paper strength.

3. Results for Improvement in Strength of Paper from Use of the Technology.

FIGS. 9, 10 and 11 display the key results of the demonstration tests as the improvement in the Tensile Index and Tensile Energy Absorption (TEA) strength of paper, especially the role of the centrally important variable, paper moisture content. The three key results of great practical significance for industrial implementation of this new technology are as follows.

With never-dried TMP hand sheets of basis weight 60 g/m$^2$ used having fibre saturation point moisture content of 0.89 kg water/kg dry sheet, when such sheets are brought from a moist paper temperature of 45° C. up to about 100° C. by rapid warming from contacting with condensing essentially saturated steam at atmospheric pressure it was determined that there are two limiting values of paper moisture content, a lower and an upper moisture content limit for achieving increased paper strength for paper brought to the elevated temperature of about 100° C.

The second essential discovery from these tests is identification of an upper moisture content limit. This concerns the characteristic that although in the lower range of moisture content a higher moisture content aids the improvement of strength, there is a relatively low upper limit for this beneficial effect. For sheet temperature brought to about 100° C., to achieve the maximum possible improvement in these two strength properties it was found sufficient to have a paper moisture content of TMP paper only about 0.3-0.5 kg water/kg dry sheet greater than the fibre saturation point value. The technology of this invention works at higher levels of moisture content but the beneficial effect obtained would not be greater than this maximum strength improvement.

The third central result from these demonstration tests is determination of the maximum possible strength improvement because this is driving force for commercial adoption of this invention. Thus the most significant outcome from these tests is to reveal that the strength improvement which can be obtained by this new technology is at the impressive levels of 31% and 24% stronger TMP paper for, respectively, Tensile Strength and Tensile Energy Absorption, TEA.

By contrast to the importance of the above three findings, the demonstration test results which are reported here for the length of time required to increase paper temperature to about 100° C. are of no general significance because, contrary to the three results listed above which would be of broad generality, these contacting time results apply only for the specific technique used for these tests. Such data are of no general importance because there are numerous more effective methods for increasing sheet temperature which could be used, as detailed in the earlier section concerning embodiments of the invention.

These commercially impressive results are through use of just one implementation technique while the description of the invention provides numerous quite different embodiments of the invention. Other embodiments are also included within the scope of the present invention. The alternative commercial implementation techniques include methods providing more rapid increase in paper temperature than used in these first demonstration tests. There is therefore great scope for a wide variety of types of industrial implementation of this invention to achieve, in novel processing steps of very short duration, these large paper property improvements.

With establishment of these major improvements in 2 commercial paper strength properties, in the range of 24% to 31% stronger paper, the change in microstructure of lignocellulosic material achieved from application of this invention would produce numerous other valuable improvements in product quality, for example improved paper mechanical properties, barrier properties, reduced liquid penetration, as well as improved surface properties giving improved optical properties and printability along with reduced linting propensity. These improvements of properties also enable increasing productivity and reducing the cost of manufacturing.

It should be appreciated that the invention is not limited to the particular embodiments described and illustrated herein but includes all modifications and variations falling within the scope of the invention as defined in the appended claims.

Experiments with Dynamic Test Facility

This facility has been described fully in the description related to FIGS. 2, 3 and 4

Type of Paper Used:

As the results, reported above, were obtained using standard hand sheets prepared in the laboratory, for the experiments done using the Dynamic Test Facility, commercial paper formed in a commercial paper machine, was used, specifically, a grade of 129 g/m$^2$ linerboard obtained in its original wet state from a paper machine of a cooperating paper company.

Secondly, our earlier work had found that paper which had been produced and dried in a paper machine, then rewetted to the effective range of moisture content above the fibre saturation point moisture content, did not react as quickly to give the improved strength we have reported using never-dried handsheets. Therefore in the present investigation using the Dynamic Test Facility we accomplished the challenging objective of obtaining paper machine formed paper in its never-dried state. The never-dried sheets were obtained at the time of a sheet break around the press section of the paper machine of the cooperating company. In this way, with the paper coming from around the press section, the never-dried sheets were obtained at a moisture content exactly of the desired range, i.e. slightly above the fibre saturation point moisture content for the furnish being used. For the grade of paper being produced, the pulp furnish used for this paper machine was 100% recycled Old Cardboard Containers, commercially termed "OCC". OCC is now a centrally important source of recycled pulp for papermaking.

Initial Temperature & Initial Moisture Content of the Paper as Tested:

As noted in the description of the Dynamic Test Facility given earlier, the Stage I of this facility consists of a humidity chamber with saturated air at the controlled temperature used, which for the results reported here was 60° C. The sheets were maintained at a moisture content of 1.2 kg water/kg dry, which is in the desired range sufficiently above the fibre saturation point of the OCC furnish.

Very Fast Increase of Temperature of the Wet Sheet to about 100° C. by Exposure to IR Emission:

As detailed in the earlier section, the sheet was subjected to IR emission of power density about 600 kW/m$^2$ emitted within the IR zone. This IR emission was sufficient to bring the temperature of the wet sheet up from 60° C. (out of Stage I) up towards 100° C. (out of Stage II), as was confirmed directly by the use of IR temperature sensors focused on the sheet just as it left the IR zone of Stage II of the Dynamic Test Facility.

Drying of the Sheet:

The earlier section provides the details concerning the warm, wet sheet at about 100° C. being dried under moderate conditions under which the sheet was taken to standard commercial dryness in about a minute, as corresponds to standard commercial practice in industrial paper machines.

Paper Property Determination:

For the determination of paper properties, the key consideration is selection of the property to be measured, as there are dozens of commercially important properties, depending on the grade and type of paper. For the grade of linerboard tested, the company providing this paper stated that the most important property is its compressive strength. Compressive strength of paper is determined in either of two standardized test procedures:

the Ring Crush Test of Compressive Strength (RTC), or the STFI Short-Span Compressive Test (SCT).

These two tests are each widely used in the paper industry. We made our measurements using the STFI Short-Span Compressive Test, which is reported to provide more reliable results.

We made our determinations using 17 test sheets. Of these sheets, 7 sheets were subjected to IR emission as specified above to bring the wet sheet very quickly to approach 100° C., while the 10 sheets to be used as the reference paper were processed in the same Dynamic Test Facility but without using IR emission. This procedure provided completely comparable conditions for the 7 sheets which were brought quickly to about 100° C. relative to the 10 reference sheets which were not warmed, used for comparison.

Paper is an intrinsically asymmetrical material due to the process used to form the sheet. Therefore the STFI Short-Span Compressive Strength was determined in both dimensions, in the direction in which the sheet moves in the paper machine, called the Machine Direction (MD) dimension, and in the direction 90° to the MD dimension, termed the Cross Machine Direction (CD).

Results:

| | | CD direction | | MD direction | |
|---|---|---|---|---|---|
| Paper | Test No. | Compressive Force N | Compressive Index[3] kN · m/kg | Compressive Force N | Compressive Index[3] kN · m/kg |
| Test Sheet[1] | 1 | 31.21 | 16.13 | 36.34 | 18.78 |
| | 2 | 32.16 | 16.62 | 27.77 | 14.35 |
| | 3 | 32.53 | 16.81 | 31.28 | 16.17 |
| | 4 | 31.32 | 16.19 | 30.12 | 15.57 |
| | 5 | 32.97 | 17.04 | 32.53 | 16.81 |
| | 6 | 32.04 | 16.56 | 32.41 | 16.75 |
| | 7 | 31.03 | 16.03 | 30.61 | 15.82 |
| Average | | 31.90 | 16.48 | 31.58 | 16.32 |
| Std. Deviation | | 0.73 | 0.38 | 2.64 | 1.37 |
| Reference Sheet[2] | 1 | 24.4 | 12.61 | 26.59 | 13.74 |
| | 2 | 24.32 | 12.57 | 22.93 | 11.85 |
| | 3 | 23 | 11.89 | 27.4 | 14.16 |
| | 4 | 24.64 | 12.73 | 26.43 | 13.65 |
| | 5 | 23.87 | 12.34 | 25.55 | 13.17 |
| | 6 | 23.63 | 12.22 | 25.94 | 13.36 |
| | 7 | 25.15 | 13 | 26.98 | 13.94 |
| | 8 | 24.84 | 12.85 | 26.41 | 13.47 |
| | 9 | 22.11 | 11.43 | 26.34 | 13.61 |
| | 10 | 24.56 | 12.69 | 26.34 | 13.61 |
| Average | | 24.05 | 12.43 | 26.09 | 13.46 |
| Std. Deviation | | 0.93 | 0.48 | 1.22 | 0.63 |

[1]Wet paper sheet subjected to fast temperature increase from 60° C. to approach 100° C.
[2]Wet paper sheet processed exactly the same except not subjected to the temperature increase
[3]Compressive Index, kN · m/kg, calculated using the sheet grammage as determined at the paper mill, 129 g/m$^2$

SUMMARY AND CONCLUSIONS

The above results were obtained with use of the Dynamic Test Facility to provide rapid increase of temperature to about 100° C. with no significant change in moisture content for wet sheets of 129 g/m$^2$ linerboard made from 100% recycled "OCC" pulp. Exceptionally, the paper used was obtained in its never-dried state directly from a large commercial paper machine at a point where the sheet moisture content was at the desired level, somewhat above the fibre saturation point moisture content for this pulp furnish.

The key commercial paper property for this grade of linerboard is Compressive Strength, determined here using the standard test called the STFI Short-Span Compressive Strength.

The results show that this rapid warming to achieve increase in temperature of the wet sheet to about 100° C. results in the following increases in STFI Compressive Index, kN·m/kg:

Strength increase in CD dimension: 16.48/12.43=32.6% increase in STFI Compressive Index.

Strength increase in MD dimension: 16.32/13.46=21.2% increase in STFI Compressive Index.

For many commercial uses of linerboard, Compressive Strength in the CD dimension is very much more important than in the MD dimension.

The key commercial strength property of this grade of linerboard used to produce boxboard and corrugated medium is Compressive Strength in the CD dimension. Thus the large increase in CD Compressive Strength, by about 33% as documented above, constitutes simply a remarkable improvement in product quality.

The results obtained in the two totally different test facilities, first with the Static Test Facility, and now with the Dynamic Test Facility, are different in the following important ways:

Static Test Facility Procedure:

Laboratory formed handsheets of 60 g/m$^2$ paper made from thermomechanical pulp, with the fast increase in sheet temperature of wet sheets to about 100° C. being obtained by condensation of saturated steam on the sheets initially at 45°

C., with the two important commercial paper properties determined being Tensile Strength and Tensile Energy Absorption (TEA).

Dynamic Test Facility Procedure:

Paper machine formed, never-dried sheets of 129 g/m$^2$ linerboard, made from 100% OCC recycled pulp, with the fast increase in sheet temperature of wet sheets to about 100° C. being obtained by exposure to high intensity IR emission from commercial IR modules to sheets initially at 60° C., with the most important commercial paper property determined being STFI Short-Span Compressive Index in the CD dimension.

In spite of all these substantial differences between the conditions used with the Static Test Facility and with the Dynamic Test Facility, it is highly significant that the increases in strength in the properties noted above are remarkably similar;

For 129 g/m$^2$ machine-formed linerboard made from 100% OCC pulp and processed in the Dynamic Test Facility: 33% increase of STFI Short-Span Compressive Index strength in the CD dimension.

For 60 g/m$^2$ hand sheets made from TMP pulp and processed in the Static Test Facility: 31% increase in Tensile Strength, and 24% increase in Tensile Energy Absorption (TEA).

This close agreement in quite different paper properties for paper treated in two such different test facilities supports the conclusion that the common factor of rapid increase in temperature of the wet sheet to about 100° C. will produce similar large improvement in many properties of many commercial grades of paper.

The invention claimed is:

1. A method of treating a wet or moist lignocellulosic material at a moisture content in a range from above the Xfsp value of the lignocellulosic material down to about 0.1 kg water/kg dry below the Xfsp value, where Xfsp is the lignocellulosic material fibre saturation point, comprising the step of rapid warming the material so that the temperature of lignocellulosic material is brought up thereby changing the micropore structure of the material improving the properties of the lignocellulosic material.

2. The method as defined in claim 1, wherein the step of rapid warming of the wet or moist lignocellulosic material to increase its temperature involves raising the lignocellulosic material temperature from the customary temperature of about 40° C. to 70° C. towards a temperature which may be as high as approaching 100° C.

3. The method of claim 1, wherein the step of rapid warming of the lignocellulosic material to increase its temperature is implemented by providing a high energy flux to the material.

4. The method of claim 1, wherein the step of rapid warming of the lignocellulosic material by providing a high energy flux is performed by electromagnetic energy.

5. The method of claim 4, wherein the electromagnetic energy is produced by Infrared emission.

6. The method of claim 5, wherein the wet or moist lignocellulosic material is in the form of a continuous web with the web having a linear speed, whereby an infrared radiation zone is provided through which the web passes with the time of exposure of the web in the infrared radiation zone may be down to the order of about 0.1 second.

7. The method of claim 5, wherein raising the temperature by rapid warming of the wet or moist lignocellulosic material is achieved by use of just enough steam to maintain steam and eliminate air at the material surface.

8. The method of claim 1, wherein the step of rapid warming of the lignocellulosic material to increase its temperature is implemented by contact with saturated steam which condenses in the lignocellulosic material.

9. The method of claim 1, wherein the lignocellulosic material is of natural polymers.

10. The method of claim 1, wherein the rapid warming of the wet or moist lignocellulosic material is by contacting saturated steam with the lignocellulosic material such that the steam condenses in the material.

11. The method of claim 1, wherein the lignocellulosic material is paper in sheet form.

12. The method of claim 1, wherein the step of rapid warming of the wet or moist lignocellulosic material is performed by passing saturated steam through the sheet so that the steam is condensed within the sheet.

* * * * *